United States Patent [19]

Neuenschwander

[11] 4,176,426

[45] Dec. 4, 1979

[54] WEB FORMING APPARATUS EMPLOYING INTERMEDIATE WEB FORMING AND SPREADING SECTION

[75] Inventor: Rudolf Neuenschwander, Swarthmore, Pa.

[73] Assignee: Scott Paper Company, Philadelphia, Pa.

[21] Appl. No.: 930,174

[22] Filed: Aug. 2, 1978

[51] Int. Cl.[2] ..... D04H 1/00

[52] U.S. Cl. ..... 19/306; 19/307; 425/82.1; 425/83.1

[58] Field of Search ..... 19/88, 89, 304, 306, 19/307, 308; 264/121, 518; 28/103; 425/82.1, 83.1; 65/9

[56] References Cited

U.S. PATENT DOCUMENTS

| | | | |
|---|---|---|---|
| 2,023,273 | 12/1935 | Lequillon | 425/82.1 X |
| 3,728,872 | 4/1973 | Thore | 19/308 X |
| 3,753,271 | 8/1973 | McBean | 19/306 X |
| 3,961,397 | 6/1976 | Neuenschwander | 19/306 X |
| 4,065,832 | 1/1978 | Neuenschwander | 19/306 |

*Primary Examiner*—Robert Mackey

*Attorney, Agent, or Firm*—Martin L. Faigus; William J. Foley

[57] ABSTRACT

An apparatus for increasing the width, or cross-machine-direction dimension of a fluid-entrained (e.g., air-entrained) stream of fibers to form a fibrous web that is wider than the stream of fibers. A rotatable spreading roll having a foraminous outer surface obliquely intercepts the open downstream end of a conveying duct through which the fluid-entrained stream of fibers is directed, and an intermediate web, wider than the stream of fiber in the first conveying duct, is deposited on this foraminous surface. The spreading roll is rotated to direct the intermediate web into communication with the upstream end of a second conveying duct, and a pressure differential established through the apparatus functions to relaunch the fibers of the intermediate web into the second conveying duct, and ultimately onto a foraminous forming surface to form a fibrous web product that is wider than the initially formed stream of fibers in the first conveying duct.

4 Claims, 3 Drawing Figures

WEB FORMING APPARATUS EMPLOYING INTERMEDIATE WEB FORMING AND SPREADING SECTION

TECHNICAL FIELD

This invention relates generally to an apparatus for forming a fibrous structure from a stream of fluid-entrained fibers, and more particularly, to forming such a structure that is wider than the initially created stream of fibers.

Reference throughout this application, including the claims, to "fibrous structure" or "fibrous web" is intended to refer to both low basis weight structures less than 6 oz/yd$^2$ and considerably heavier structures often referred to as "mats" or "batts".

BACKGROUND ART

In both wet-lay and air-lay web forming operations, fibers are conveyed in a fluid stream onto a foraminous surface to form the fibrous web. In commercial installations, it is highly desirable to increase product output to thereby minimize the unit cost of manufacturing, and this is particularly important when manufacturing single and limited use items, such as cosmetic pads, industrial towels, household towels, facial tissues, impregnated wipes, components of disposable diapers and sanitary napkins, etc. Products of this type must be economically manufactured so that they can be sold profitably at a price that is sufficiently low to justify their frequent disposal.

One way of increasing production output in a web forming line is to first form the fibrous web several times wider than the desired width of the final product, and thereafter sever the web in laterally spaced-apart regions to form several web sections from which the product can be formed. This technique can be very advantageously employed in the formation of single and limited use air-lay products that are intended to compete with products made by faster wet-lay processes.

One approach to forming wide webs is disclosed and claimed in U.S. Pat. No. 4,065,832, issued to Rudolf Neuenschwander, and assigned to Scott Paper Company. The preferred apparatus disclosed in this patent includes a foraminous forming surface obliquely oriented to the direction of fiber flow through the conveying duct, and this surface intercepts the downstream end of the duct so that its lateral dimension between laterally spaced-apart duct sidewalls is greater than the width of the downstream end of the duct, as measured in a direction generally normal to the direction of fiber flow through the duct. In the apparatus disclosed in the Neuenschwander patent, a web of the desired basis weight is directly deposited on the obliquely oriented forming surface, and then is conveyed to subsequent post-treatment operations, if desired.

The oblique orientation between the forming surface and the conveying duct establishes an acute angle $\alpha$ between one of the duct sidewalls and the forming run of the foraminous member, as is clearly shown in FIG. 1 of the Neuenschwander patent. This angular relationship establishes a restricted area adjacent the edge of the duct to cause the formation of a thin edge; especially in thick webs. When it is necessary or desirable for the web to have a substantially uniform thickness across its entire cross-machine-direction, the thin edges must be removed; thereby resulting in production inefficiency. Thus, the apparatus disclosed in the U.S. Pat. No. 4,065,832 is not sufficiently versatile to form webs with a substantially uniform thickness from edge to edge over a wide range of basis weights. The present invention relates to a modification of the system described and claimed in the U.S. Pat. No. 4,065,832, and provides a degree of versatility which the U.S. Pat. No. 4,065,832 system does not possess.

DISCLOSURE OF INVENTION

In accordance with this invention, an apparatus is provided for fluid-forming (e.g., air-forming) a fibrous structure by first forming an intermediate web that is wider than the width of a fluid-entrained stream of fibers from which the intermediate web is initially formed.

The apparatus of this invention includes a conveying duct for receiving a fluid-entrained stream of fibers at its upstream end, and an intermediate rotatable spreading roll obliquely intercepting a downstream end of the duct and having a foraminous surface upon which the intermediate web is formed. This foraminous surface has a lateral dimension between spaced-apart duct sidewalls that is greater than the width of the duct at its downstream end, as measured between the duct sidewalls in a direction generally normal to the direction of fiber flow through the duct, whereby the intermediate web formed on the foraminous surface is wider than the stream of fluid-entrained fibers directed through the duct. The intermediate spreading roll includes a plurality of internal, axially spaced-apart disks supporting the foraminous member, and these disks provide internal channels for receiving the air or other fluid employed to convey the fibers onto the foraminous surface. The intermediate spreading roll preferably intercepts the upstream end of a second conveying duct that is spaced from the downstream end of the first conveying duct. A pressure differential is established across the apparatus to aid in directing the air-entrained fibers onto the foraminous surface of the spreading roll, and also to direct the air of the stream through the internal channels of the spreading roll and through the foraminous screen adjacent the upstream end of the second duct to relaunch the intermediate web, and thereby establish an air suspension of fibers in the second conveying duct that is wider than the air suspension of fibers in the first conveying duct. Therefore, in the preferred embodiment of this invention, the air movement created by the pressure differential across the apparatus aids in both forming the intermediate web, and thereafter relaunching it to reform an air-suspension of fibers in the second conveying duct.

If desired the air-suspension of fibers directed into the second duct, which is of a width substantially equal to that of the intermediate web structure, can be directly deposited on a web forming surface in a wide variety of basis weight ranges while eliminating, or minimizing the formation of thin edges. To further explain, since the second conveying duct need not be utilized in conjunction with an obliquely oriented roll to increase the width of web formation, it can be oriented so that its sidewalls do not form a restricting acute angle with the forming surface. Although the intermediate spreading roll does provide such a restricting angle with one side wall of the first duct, the intermediate web can be formed sufficiently thin to minimize undesirable edge effects. Thereafter, a thicker final web can be formed from the intermediate web by relaunching the intermediate web as a stream of fluid-entrained fibers into the second duct, and then directing the relaunched fibers onto a forming surface moving at a slower linear speed than the foraminous surface of the intermediate spreading roll. Moreover, by initially forming an intermediate web structure prior to final web formation an opportunity exists for smoothing out the flow, and thereby improving the overall uniformity of the finally formed web.

Although this invention employs features disclosed in the earlier-discussed, U.S. Pat. No. 4,065,832 it also includes a unique arrangement of elements for initially forming an intermediate web that is wider than an air stream of fibers from which the web is formed, and thereafter relaunching the initially formed web prior to formation of the final web. Such an arrangement is not suggested by the U.S. Pat. No. 4,065,832.

Other objects and a fuller understanding of the invention will be had by referring to the following description and claims directed to the best mode for carrying out this invention, taken in conjunction with the accompanying drawings, wherein similar reference characters refer to similar parts through the several views.

BEST MODE FOR CARRYING OUT THE INVENTION

Figure 1:
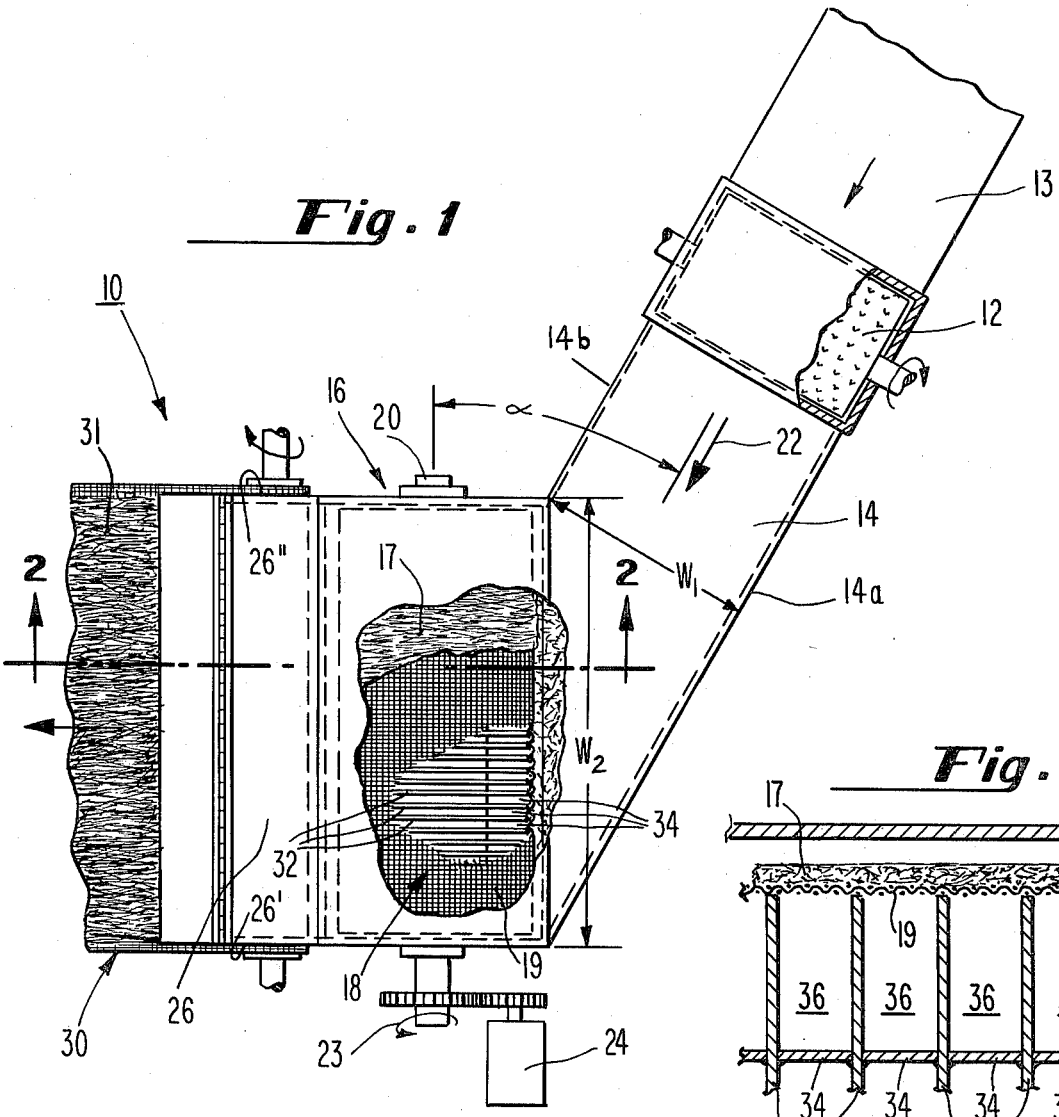
FIG. 1 is a schematic plan view of the apparatus of this invention with parts broken away to show details of construction.

Referring to FIG. 1, the apparatus in accordance with the preferred embodiment of this invention is an air-lay device 10 including a fiberizing roll 12 for separating fibers from a feed mat or sheet 13, and directing the separated fibers in an air stream through a first conveying duct 14. The construction of the fiberizing roll, the feed system for the sheet 13 (not shown), and the conveying duct 14 can be identical to the construction disclosed in U.S. Pat. No. 4,065,832, issued on Jan. 3, 1978, to Rudolf Neuenschwander, and herein incorporated by reference.

In accordance with this invention, an intermediate spreading assembly 16 is employed to form an intermediate web 17, prior to final web formation, that is wider than the stream of air-entrained fibers in the first conveying duct 14. Thereafter, the intermediate web can be employed to form a final web over a wide range of basis weights while eliminating or minimizing the formation of thin edges.

In accordance with this invention, the conveying duct 14 is intercepted at its downstream end by the spreading assembly 16, and this assembly employs a unique spreading roll 18, as will be described in greater detail hereinafter. The spreading roll has an outer foraminous member 19, in the form of a screen, upon which the air-entrained fibers in the duct are deposited to form the intermediate web 17, and this spreading roll is secured to a rotatably mounted axle 20 that is oriented at an oblique angle $\alpha$ relative to the general direction of flow through the conveying duct 14, as is indicated by the arrow 22. This direction of flow is generally parallel to the longitudinal axis of the duct 14.

Referring specifically to FIG. 1, the width, $W_1$, of the downstream end of the conveying duct is the distance between laterally spaced-apart sidewalls 14*a* and 14*b*, as measured generally normal to the direction of material flow through said duct. This duct width is less than the axial dimension, $W_2$, of the section of the roll 18 between the duct sidewalls 14*a* and 14*b*, and this axial dimension is calculated by the following formula:

$$W_2 = W_1/\text{sine } \alpha$$

wherein: $W_1$ is the width of the conveying duct 14 adjacent its downstream end, as measured between the laterally spaced-apart sidewalls 14*a* and 14*b* in a direction generally normal to the direction of material flow through the duct; and $\alpha$ is the included angle between the axle of the spreading roll 18 and the general direction of material flow through the conveying duct 14.

Figure 2:
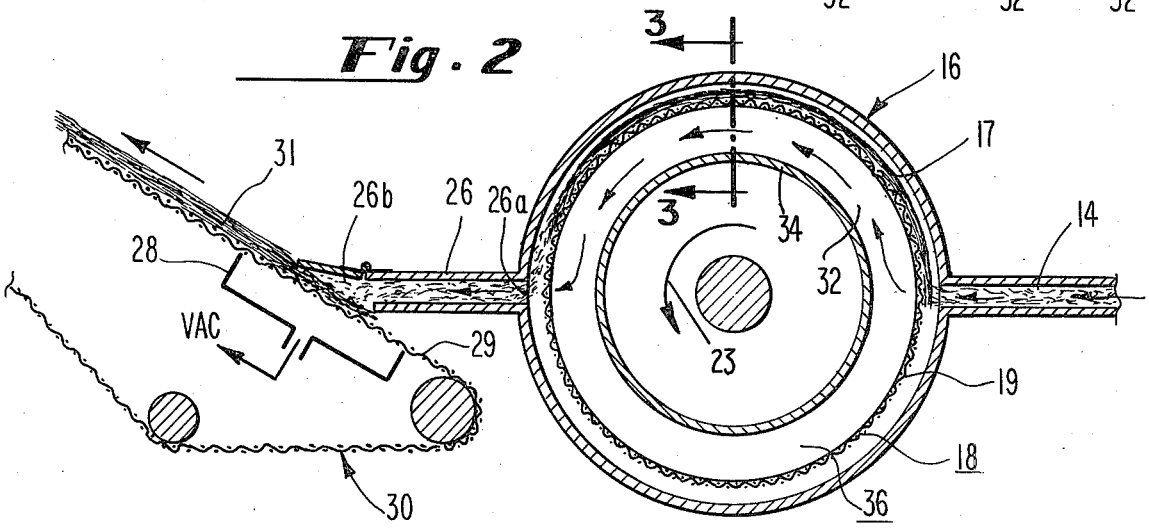
FIG. 2 is a sectional view taken along line 2—2 of FIG. 1.

Referring to FIGS. 1 and 2, the spreading roll 18 is driven in the direction indicated by arrow 23 by a motor 24, or other suitable drive system, to convey the wide, intermediate web 17 to the upstream end 26*a* of a second conveying duct 26. This second conveying duct has a downstream end 26*b* intercepted by the web forming run 29 of a foraminous conveyor 30, and a vacuum box 28 is positioned beneath the forming run in alignment with the second conveying duct. The fibers of the intermediate web are launched into the second conveying duct and deposited on the web forming run 29 in the form of a fibrous web structure 31, in a manner that will be described in greater detail hereinafter.

Figure 3:
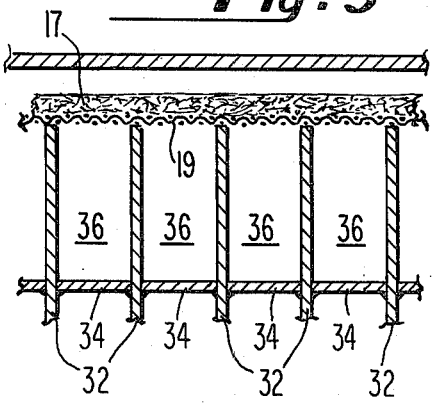
FIG. 3 is a sectional view taken along line 3—3 of FIG. 2 and showing details of the unique flow spreading assembly of this invention.

Referring to FIGS. 1–3, the obliquely oriented spreading roll 18 includes a plurality of internal vanes, or baffles, in the form of axially spaced-apart circular disks 32. These disks are maintained in their spaced-apart relationship by cylindrical spacers 34 that are concentric with, and have a smaller diameter than the disks. The foraminous member 19 of the roll is positioned around the outer periphery of the disks 32, and these disks, in conjunction with the outer surface of the cylindrical spacers 34, form a plurality of air-flow receiving channels 36. These channels directly underlie the member 19, and as can be seen best in FIG. 2, are annular in cross-section, and directly communicate the first conveying duct 14 with the second conveying duct 26.

A pressure differential is established across the apparatus 10 by directing air into the upstream end of the first conveying duct 14 under positive pressure with a fan or other suitable blower (not shown), and by maintaining the downstream end of the apparatus at a lower pressure. By establishing this pressure differential, the air directed into the upstream end of the first conveying duct 14 will entrain fibers separated from the feedmat 13 by the fiberizing roll 12, and will convey the entrained fibers onto the foraminous member 19 of the spreading roll 18 to thereby form the intermediate web 17. The air entraining the fibers will pass through the foraminous member 19, and then will be turned by movement through the air-flow receiving channels 36. When the air stream in the channels approaches the upstream end 26*a* of the second conveying duct 26, the pressure differential will cause the air to move outwardly from the channels 36 and through the screen 19 to relaunch the intermediate fibrous web 17, and to suspend the fibers thereof in air in said second conveying duct. Thereafter, the relaunched fibers will be directed through the duct and onto the web forming run 29 of the conveyor 30 to form the fibrous web 31. To aid in guiding the fibers onto the forming run 29, a slight suction force is established through the vacuum box. The air that is directed through the forming run 29 will be received by the vacuum box, and can either be disposed of or recycled, as desired. Thus, the air that is moved through the apparatus 10 by the creation of the pressure differential functions to initially deposit the intermediate web 17 on the surface of the obliquely oriented spreading roll 18, to relaunch the web into an air stream in the second conveying duct 26 and to deposit the relaunched fibers on the forming conveyor 30.

As can be seen best in FIG. 1, the sidewall 26', 26'' of the second conveying duct 26 are generally perpendicular to the forming surface of the conveyor 30 so that a substantially uniform cross-machine-direction basis weight profile can be established over a wide range of basis weights. In other words, this invention eliminates, or at least minimizes the formation of thin edges in the fibrous web product 31.

In accordance with this invention, the intermediate web 17 deposited on the foraminous periphery of the spreading roll 18 can be of a relatively thin, low basis weight structure to minimize undesirable edge effects created by the angular relationship between the outer periphery of the roll and the sidewall 14*a* of the conveying duct 14. The intermediate web can then be relaunched into the second conveying duct 26, and the speed of the conveyor 30 controlled to form the final product of the desired basis weight. For example, by moving the conveyor 30 at a slower linear speed than the spreading roll 18 the basis weight of the web structure 31 formed on the conveyor 30 will be greater than the basis weight of the intermediate web 17. This is accomplished without experiencing the undesirable edge effects that can occur when directly forming a thick, heavy basis weight structure on the surface of a roll that is obliquely oriented to the duct in which the fibers are conveyed.

Although the invention has been described with a certain degree of particularity, it is understood that the present disclosure has been made only by way of example, and that numerous changes in the details of construction and in the combination and arrangement of parts may be resorted to without departing from the scope of the invention.

Having described my invention I claim:

1. A web forming apparatus including:

a first conveying duct through which a fluid-entrained stream of fibers is adapted to move from an upstream end to a downstream end thereof;

an intermediate rotatable spreading roll obliquely oriented to the first conveying duct and intercepting the downstream end thereof between laterally spaced-apart duct sidewalls, said roll including a foraminous member having an outer surface for receiving the fluid-entrained fibers thereon and passing the fluid therethrough, said foraminous outer surface having a lateral dimension between the duct sidewalls that is greater than the width of the duct at its open downstream end, as measured between the duct sidewalls in a direction generally normal to the direction of fiber flow;

a second conveying duct having an upstream end spaced from the downstream end of the first conveying duct and being intercepted by the outer surface of the spreading roll; and means for establishing a pressure differential across the apparatus to aid in initially depositing the fibers on the outer periphery of the intermediate spreading roll and relaunching the fibers into the second conveying duct adjacent the upstream end thereof.

2. The apparatus of claim 1 wherein said intermediate spreading roll includes a plurality of internal, axially spaced-apart disks providing internal fluid-flow channels communicating, through the foraminous member of the roll, with the interior of the first and second conveying ducts.

3. The apparatus of claims 1 or 2 including a foraminous forming surface intercepting the downstream end of the second conveying duct for receiving the relaunched fibers in the form of a fibrous web.

4. The apparatus of claim 3 including a fiberizing means adjacent the upstream end of the first conveying duct for separating fibers from a fibrous feed and directing the fibers into the upstream end of said first conveying duct.

* * * * *